US005577521A

United States Patent [19]

Neitlich

[11] Patent Number: 5,577,521

[45] Date of Patent: Nov. 26, 1996

[54] DEVICE TO PROVIDE FOR POLISHING FINGERNAILS

[76] Inventor: Steven Neitlich, 463 Normandy Dr., Norwood, Mass. 02062

[21] Appl. No.: 277,240

[22] Filed: Jul. 19, 1994

[51] Int. Cl.[6] ..... A45D 29/00

[52] U.S. Cl. ..... 132/285; 132/73; 132/73.5; 2/21; 128/880

[58] Field of Search ..... 132/285, 73, 73.5; 2/21; 128/880

[56] References Cited

U.S. PATENT DOCUMENTS

| | | | |
|---|---|---|---|
| 1,231,270 | 6/1917 | Knudsen | 132/73.5 |
| 2,485,384 | 10/1949 | Klein | 132/285 |
| 2,524,322 | 10/1950 | Lipnicki et al. | 132/285 |
| 5,143,100 | 9/1992 | Kawakami | 132/73 |

FOREIGN PATENT DOCUMENTS

| | | | |
|---|---|---|---|
| 162568 | 5/1921 | United Kingdom | 132/73 |

*Primary Examiner*—Gene Mancene
*Assistant Examiner*—Pedro Philogene
*Attorney, Agent, or Firm*—William J. Daley, Jr.

[57] ABSTRACT

The present invention provides a device for polishing fingernails. The polishing fingernail device comprises an integral structure having a forward portion for the fingernail section and a rearward portion for a portion of the finger rearwardly from the fingernail. The forward portion extends about the side ends of the nail and the rear end of the nail. In another embodiment the forward portion includes a section which extends under and about the forward portion of the nail being treated. The rearward portion extends about the top and side portion of the finger with a mechanism, such as a belt to releasably secure the polishing fingernail device to the finger.

14 Claims, 2 Drawing Sheets

DEVICE TO PROVIDE FOR POLISHING FINGERNAILS

BACKGROUND OF THE INVENTION

1. Field of the Invention

The present invention relates to a fingernail polish stencil and support and more particularly to a new and improved type of device adapted to provide a human fingernail and constitute a stencil for the lacquering of the fingernail or providing polish on the fingernails without any contact to finger of the fingernail being treated.

2. Description of Prior Art

There are numerous devices in the prior art for fingernail polish devices. The following U.S. Patents are believed to exemplify the present state of the art with respect to fingernail polishing devices.

U.S. Pat. No. 2,220,758 discloses a stencil for polishing fingernails, comprising a flat tubular member having the front portion of its bottom wall cut away, a stencil element extending through said tubular member and adapted to be shifted forward and rearward and having a rearward projecting rear and forming a handle, a fulcrum on the central part of the bottom wall of said tubular member and projecting downwards for engaging one's finger, and a resilient band mounted on the front of said tubular member for engaging about one's finger for holding the front end of said stencil element on the fingernail.

U.S. Pat. No. 2,287,062 discloses improvements in toilet accessories and has particular reference to a device in the form of a shield for the fingers of the hand capable of encircling any of the selected fingers and serving to confine a tinted or polished solution entirely to the surface of the fingernail, thus preventing the solution from contacting or soiling the flesh of the finger during the act of ornamenting the fingernail to enhance its appearance.

U.S. Pat. No. 2,485,384 discloses a substantially cylindrical casing which is formed with a longitudinal split, which casing is cut away to form a stencil conforming to the shape of the human finger nail across the top, the casing being mounted on a resilient handle portion comprising a bight, on the two legs of which are mounted the respective halves of the split cylindrical casing. Between the bight portion and the casing, the legs of the handle are crossed so that pressing inward on the bight causes the split halves of the casing to separate laterally. Extending on a lateral axis between the legs of the bight is a coil spring pushing outward against the legs, tending to keep the halves of the casing together. The nail support is a substantially U-shaped member having at its ends substantially rectangular shoes which are slidably mounted in channels on the outside of the casing and extending longitudinally thereof.

The foregoing patents as well and the following U.S. patents are believed to exemplify the present state of the art with respect to such fingernail polishing devices.

U.S. Pat. No. 2,428,152

U.S. Pat. No. 2,557,759

U.S. Pat. No. 2,654,375

While these prior art patents provide improvements in the area intended, there still exists a great need for a new and improved device for polishing fingernails and which is relatively simple in construction, applying to the finger and about the fingernail, and protects the finger when polishing the fingernail.

Accordingly, a principle desirable object of the present invention is to provide a new and improved device to provide for polishing fingernails.

Another desirable object of the present invention is to provide a fingernail form device which is reusable and which overcomes all of such disadvantages and which provides the unusual combinations and subcombinations of advantages in construction, fabrication, made of operation and adaptability and comfort in operation.

Another desirable object of the present invention is to provide a fingernail form device which may easily and quickly be applied to a finger about the nail to be treated by using only one hand of the operator and which may be easily removed and transferred from one fingernail to another.

A further desirable object of the present invention is to provide a fingernail polishing device which may easily and quickly be applied to a finger to be treated by using only one hand of the user and which may be easily removed and transferred from one fingernail to another.

A still further desirable object of the present invention is the production of a fingernail polishing device that is simple in construction, economical to manufacture, durable, positive in operation, and greatly efficient in use.

These and other desirable objects of the present invention will in part appear hereinafter and will in part become apparent after consideration of the specification with reference to the drawings and claims.

SUMMARY OF THE INVENTION

The present invention discloses a new and improved device to provide for polishing fingernails. The polishing fingernail device comprises an integral structure having a forward portion for the fingernail section and a rearward portion for a portion of the finger rearwardly from the fingernail. In one embodiment the forward portion extends about the side end of the nail and the rear end of the nail. In another embodiment the forward portion includes a section which extends under and about the forward portion of the nail so that the top portion of the nail can be treated without contacting the finger about the nail. The rearward portion extends about the top and side portion of the finger with means for releasably securing the polishing fingernail device to the finger. The forward portion is provided with a flexible attachable device secured on the bottom portions of the forward portion to maintain the forward portion about the rear and side ends of the nail.

BRIEF DESCRIPTION OF THE DRAWINGS

For a fuller understanding of the nature and desired objects of the present invention, reference should be made to the following detailed description taken in conjunction with the accompanying drawings wherein like reference characters denote corresponding parts throughout several views and wherein.

DETAILED DESCRIPTION OF PREFERRED EMBODIMENT(S)

Figure 1:
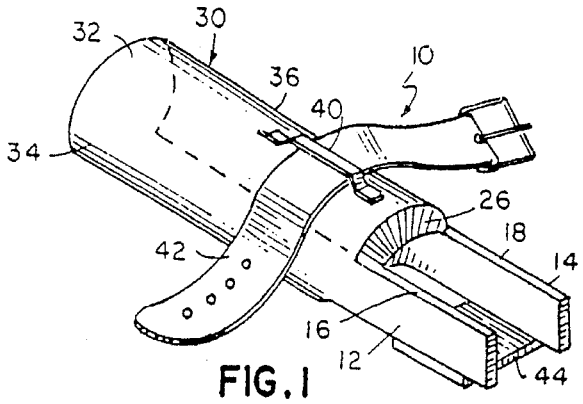
FIG. 1 is a perspective view of a device embodying the present invention to provide for polishing fingernails.
Figure 2:
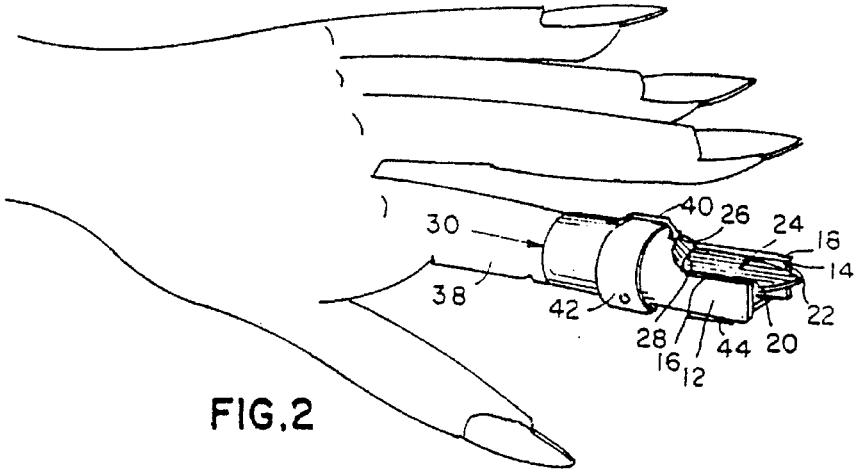
FIG. 2 is a perspective view of the polishing fingernail device applied to a finger.
Figure 3:
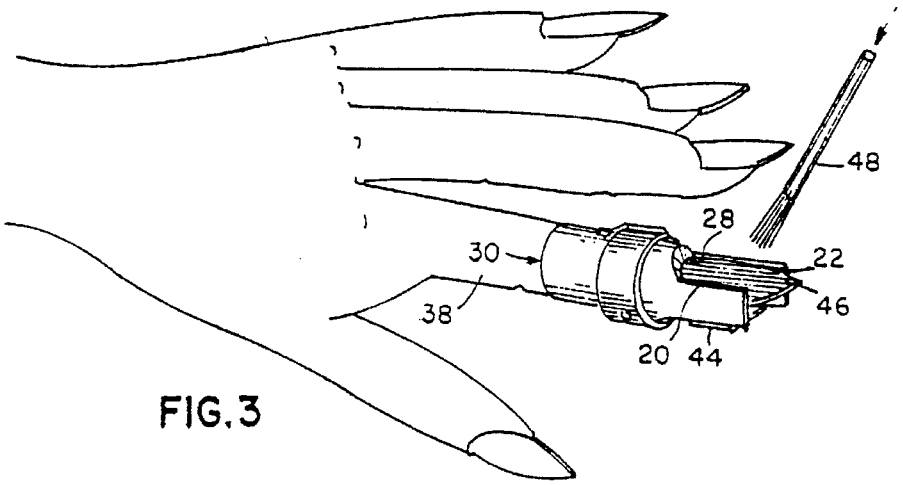
FIG. 3 is a perspective view of the polishing fingernail device with an illustration of the ability to polish a fingernail.

Referring now to the drawings and more particularly to FIGS. 1–3, there is illustrated an embodiment of the principles of the present invention device to provide for polishing fingernails illustrated generally by the numeral 10. The fingernail polishing device has two forward side wall sections 12 and 14 which each have top portions 16 and 18 which contact adjacent to the outside areas 20 and 22 of the nail 24 and a back position 26 which contacts adjacent to the back area 28 of the nail 24. The rearward portion 30 has an upper area 32 and side wall areas 34 and 36 which covers over the top and side portions of the fingers 38. The polishing fingernail device 10 includes a strap 40 and a belt 42 extended under the strap 40 which secures the polishing fingernail device 10 on a finger 38 as illustrated in FIGS. 2 and 3. Another important feature is an expandable support device 44 which is attached to the bottom portions of the side wall sections 12 and 14. The support device 44 supports the finger 38 between side wall sections 12 and 14 and keeps the side wall sections 12 and 14 together and keeps them including the top portions 16 and 18 adjacent to the outside areas 20 and 22 of the nail 24 as indicated in FIGS. 2, 3, 5, 6 and 7. As illustrated in FIG. 3, the nail 24 is then easily polished with a selected color material such as 46 by a painting device such as 48.

Figure 4:
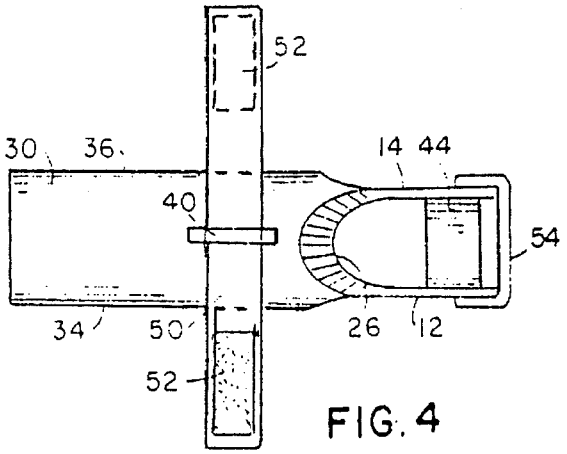
FIG. 4 is a top plan view of the polishing fingernail device with two alternate embodiments.
Figure 5:
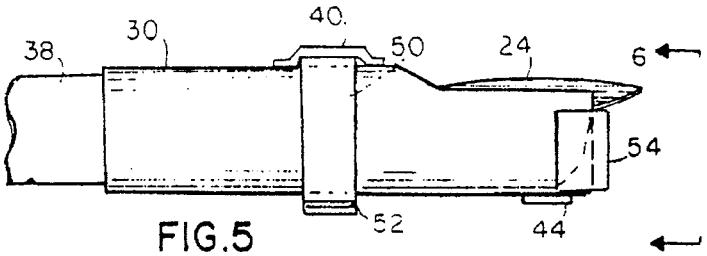
FIG. 5 is a side view of the device of FIG. 4.
Figure 6:
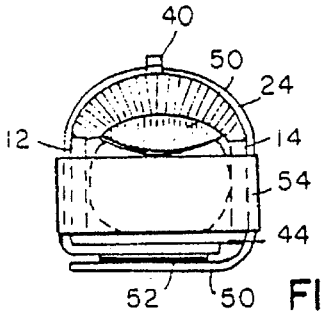
FIG. 6 is a front view of the lines 6—6 of FIG. 5.
Figure 7:
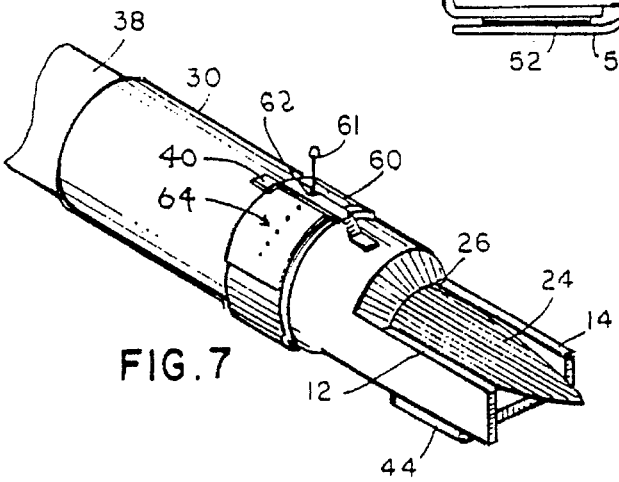
FIG. 7 is a perspective view of an alternate embodiment of a securing device.

Referring now to FIGS. 4–7, there are illustrated alternate embodiments to the device 10 to provide for polishing fingernails. In FIGS. 4–6 the belt 50 is provided with strips of velcro devices 52 which are dense piles that interlock when pressed together. In FIG. 7 the belt 60 is secured with a pin device 61 that secures the belt 60 in fixed position when the pin 61 is attached through a hole 62 of the strap 40 and into one of the openings 64 of the belt 60.

Also included in FIGS. 4–6 is a resilient strap band 54 which is fixed between the forward portions of the side wall sections 12 and 14 which extends partially under and about the forward portion of the nail 24 to fix the nail 24 of the finger 38 in proper position to prevent painting contacting the finger under the nail 24.

While the invention has been described with respect to preferred embodiments, it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A device for attaching to a portion of a finger to provide for polishing only the fingernail comprising:

an integral structure having a forward portion for the fingernail section and a rearward portion for a portion of the finger rearwardly from the fingernail;

said forward portion having forwardly extending side walls and a rear end that extends over the finger;

said rearward portion extending about a portion of the finger; and a means for removable securing said integral structure to the finger for polishing, wherein said removable securing means includes a strap attached to an upper portion of said integral structure and a belt, extending under the strap, to secure said integral structure on the finger.

2. A fingernail polishing device according to claim 1 wherein said rearward portion extends about a portion of the top and sides of the finger.

3. The fingernail polishing device according to claim 1 further including a support device attached to bottom portions of said side walls of said forward portion, that supports the finger between said side walls and keeps said side walls adjacent to portions of the fingernail.

4. The fingernail polishing device according to claim 1 further including a section device fixed between forward portions of said side walls, said section device extending partially under and about the forward portion of the fingernail.

5. A device for attaching to a portion of a finger to provide for polishing only the fingernail comprising:

an integral structure having a forward portion for the fingernail section and a rearward portion for a portion of the finger rearwardly from the fingernail;

said forward portion having forwardly extending side walls and a rear end that extends over the finger;

said rearward portion extends about a portion of the top and sides of the finger; and wherein the integral structure includes a strap attached to an upper portion of said integral structure and a belt, extending under the strap, to secure said integral structure on the finger.

6. The fingernail polishing device according to claim 5, further including a resilient strap band fixed between forward portions of said side walls so as to extend partially under and about the forward portion of the fingernail.

7. The fingernail polishing device according to claim 5, further including a support device attached to bottom portions of said side walls of said forward portion, that supports the finger between said side walls and keeps said side walls adjacent to portions of the fingernail.

8. The fingernail polishing device according to claim 5, wherein said belt includes a hook and loop type fastener that, when pressed together, secures the fingernail polishing device on the finger.

9. The fingernail polishing device according to claim 8, further including a resilient strap band fixed between forward portions of said side walls so as to extend partially under and about the forward portion of the fingernail.

10. The fingernail polishing device according to claim 8, further including a support device attached to bottom portions of said side walls of said forward portion, that supports the finger between said side walls and keeps said side walls adjacent to portions of the fingernail.

11. The fingernail polishing device according to claim 5, further comprising a pin device that secures said belt in fixed position, wherein said pin device extends through a hole of the strap and into an opening in the belt so the fingernail polishing device is secured on the finger.

12. The fingernail polishing device according to claim 11, further including a resilient strap band fixed between forward portions of said side walls so as to extend partially under and about the forward portion of the fingernail.

13. The fingernail polishing device according to claim 11, further including a support device attached to bottom portions of said side walls of said forward portion, that supports the finger between said side walls and keeps said side walls adjacent to portions of the fingernail.

14. A device for attaching to a portion of a finger to provide for polishing only the fingernail comprising:

an integral structure having a forward portion for the fingernail section and a rearward portion for a portion of the finger rearwardly from the fingernail;

said forward portion having forwardly extending side walls and a rear end that extends over the finger;

said rearward portion extends about a portion of the top and sides of the finger;

a resilient strap band fixed between forward portions of said side walls that extends partially under and about the forward portion of the fingernail;

a support device attached to bottom portions of said side walls of said forward portion, that supports the finger between said side walls and keeps said side walls adjacent to portions of the fingernail; and a means for removable securing said integral structure to the finger for polishing, wherein said removable securing means includes a strap attached to an upper portion of said integral structure and a belt, extending under the strap, to secure said integral structure on the finger.

* * * * *